US006832456B1

(12) United States Patent
Bilowol

(10) Patent No.: US 6,832,456 B1
(45) Date of Patent: Dec. 21, 2004

(54) FRAME UNIT FOR USE IN CONSTRUCTION FORMWORK

(76) Inventor: Peter Bilowol, PO Box 546, Nerang, Qld. (AU), 4211

( * ) Notice: Subject to any disclaimer, the term of this patent is extended or adjusted under 35 U.S.C. 154(b) by 0 days.

(21) Appl. No.: 09/581,187

(22) PCT Filed: Dec. 18, 1998

(86) PCT No.: PCT/AU98/01059

§ 371 (c)(1),
(2), (4) Date: Jul. 27, 2000

(87) PCT Pub. No.: WO99/32741

PCT Pub. Date: Jul. 1, 1999

(30) Foreign Application Priority Data

Dec. 18, 1997 (AU) ..... PP0967

(51) Int. Cl.[7] ..... E04G 11/08; E04G 17/12; E04G 17/065

(52) U.S. Cl. ..... 52/426; 52/565; 52/649.8; 52/699; 249/38; 249/40; 249/47; 249/190; 249/192; 249/213

(58) Field of Search ..... 52/309.11, 309.12, 52/425, 426, 562, 565, 649.1, 649.8, 686, 719, 699, 687, 688, 379; 249/38, 44, 190–192, 33, 40, 42, 47, 45, 213

(56) References Cited

U.S. PATENT DOCUMENTS

| | | | | | |
|---|---|---|---|---|---|
| 1,526,776 | A | * | 2/1925 | Daldz | |
| 1,575,931 | A | * | 3/1926 | Orlopp | 52/715 |
| 1,815,368 | A | * | 7/1931 | Wotnonske | |
| 2,019,195 | A | * | 10/1935 | Simpson | |
| 2,099,260 | A | * | 11/1937 | Colt | 249/43 |
| 2,523,131 | A | * | 9/1950 | Martin | |
| 2,595,123 | A | * | 4/1952 | Callan | |
| 2,642,646 | A | * | 6/1953 | Johnston | |
| 2,704,390 | A | * | 3/1955 | Hummel | |
| 2,887,757 | A | * | 5/1959 | Miles | 52/699 |
| 3,197,171 | A | * | 7/1965 | Michalak | 249/40 |
| 3,263,956 | A | * | 8/1966 | Hawkins | |
| 3,314,207 | A | * | 4/1967 | Sigl | |
| 3,435,567 | A | * | 4/1969 | Tyson | |
| 3,447,771 | A | * | 6/1969 | Trimmer | |
| 3,728,836 | A | * | 4/1973 | Gates | 52/687 |
| 3,861,096 | A | * | 1/1975 | Emmons | 52/98 |
| 4,234,156 | A | * | 11/1980 | Wepf | 249/40 |
| 4,604,843 | A | | 8/1986 | Ott et al. | |
| 4,678,156 | A | * | 7/1987 | Scalamandre et al. | |
| 4,936,540 | A | * | 6/1990 | Boeshart | |
| 4,972,646 | A | | 11/1990 | Miller et al. | |
| 5,140,794 | A | | 8/1992 | Miller | |
| 5,218,809 | A | * | 6/1993 | Baumann | 52/653.1 |
| 5,497,592 | A | * | 3/1996 | Boeshart | 52/699 |
| 5,570,552 | A | * | 11/1996 | Nehring | 52/426 |
| 5,799,399 | A | * | 9/1998 | Schultz | 29/897.3 |
| 5,809,725 | A | * | 9/1998 | Cretti | 52/426 |

(List continued on next page.)

FOREIGN PATENT DOCUMENTS

| | | | | |
|---|---|---|---|---|
| AU | 639522 | * | 8/1991 | |
| DE | 2404841 | | 8/1975 | |
| FR | 2678310 | | 12/1992 | |
| SE | 175441 | * | 5/1961 | 52/426 |

*Primary Examiner*—Robert Canfield
(74) *Attorney, Agent, or Firm*—Hoffman Wasson & Gitler PC

(57) ABSTRACT

A frame unit (11) used in the construction of a formwork module. The frame unit (11) is formed by connecting together rectangular loops of wire (12, 13) to form a rectangular block shape. Panels (60) and reinforcement (16) are connected to the frame to make a formwork module, with the reinforcement (16) extending beyond the sides of both the frame unit (11) and the panels (60). When a number of modules are connected together to form formwork for the desired building structure, the reinforcement (16) overlaps to form a continuous line of reinforcement from one module to the next.

12 Claims, 14 Drawing Sheets

U.S. PATENT DOCUMENTS 5,833,873 A * 11/1998 Adonetti
5,836,126 A * 11/1998 Harkenrider et al. ..... 52/410
5,895,188 A * 4/1999 Cheng ..... 411/433
6,070,380 A * 6/2000 Meilleur ..... 52/309.7
6,202,375 B1 * 3/2001 Kleinschmidt ..... 52/309.11
6,231,024 B1 * 5/2001 Kugimiya et al. ..... 249/33
6,231,025 B1 * 5/2001 Tukemura ..... 249/40
6,502,802 B2 * 1/2003 Jorn et al. ..... 249/194
6,536,180 B1 * 3/2003 Rosenblat et al. ..... 52/712

* cited by examiner

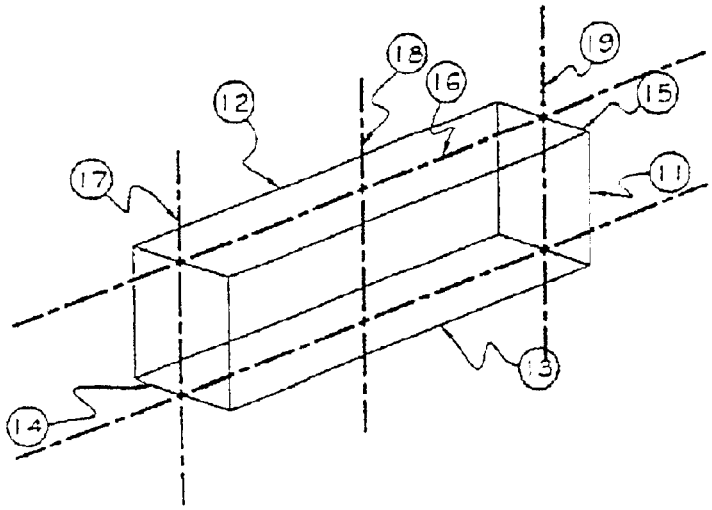
FIGURE
(3D VIEW)
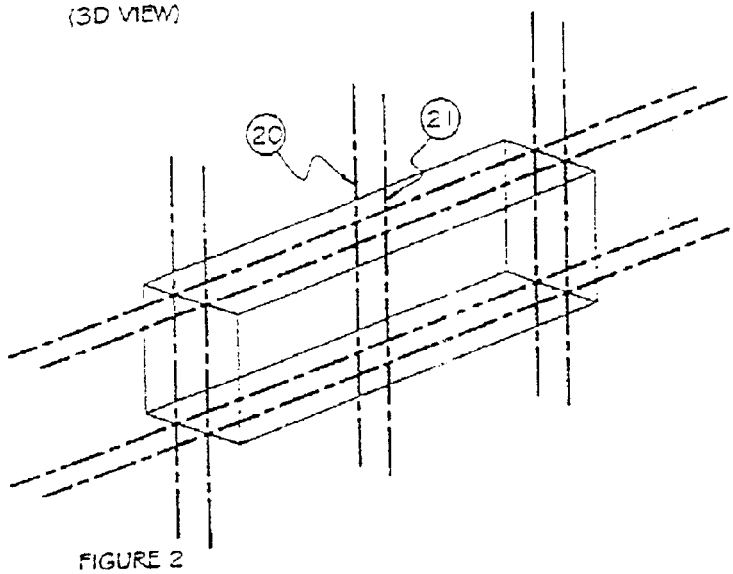
FIGURE 2
(3D VIEW)
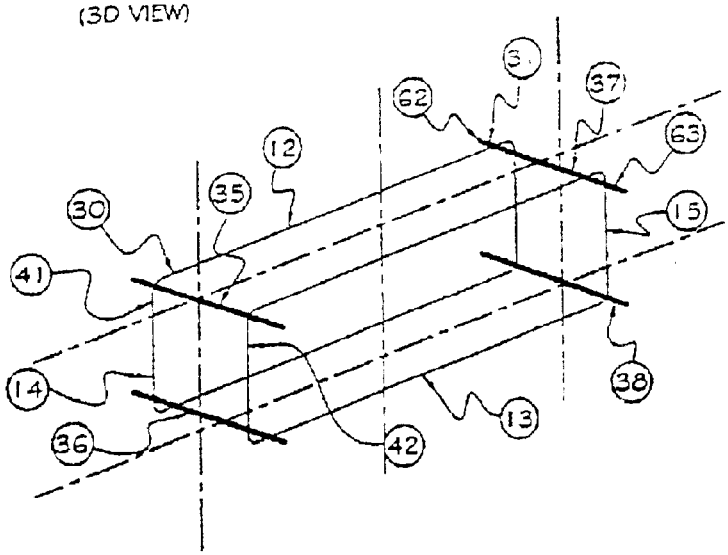
FIGURE 3
(3D VIEW)

(ELEVATION)

(ELEVATION)

(PLAN)

(ELEVATION)

(3D VIEW)

(3D VIEW)

(3D VIEW)

(3D VIEW)

(3D VIEW)

(3D VIEW)

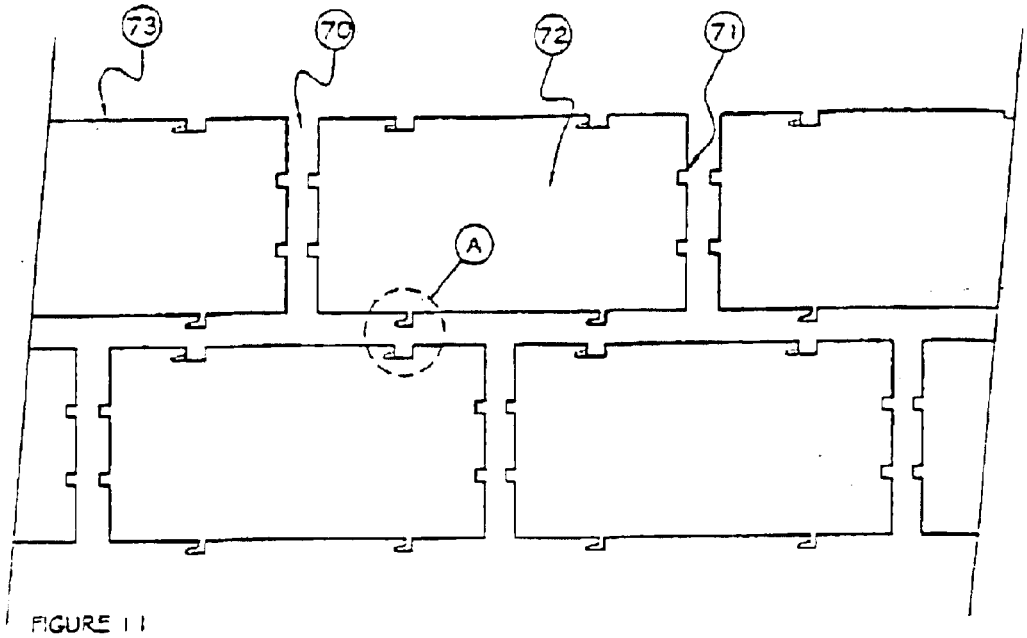
FIGURE 11
(ELEVATION)
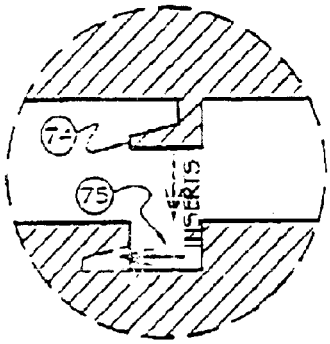
FIGURE 12 - DETAIL 'A'
(ELEVATION)
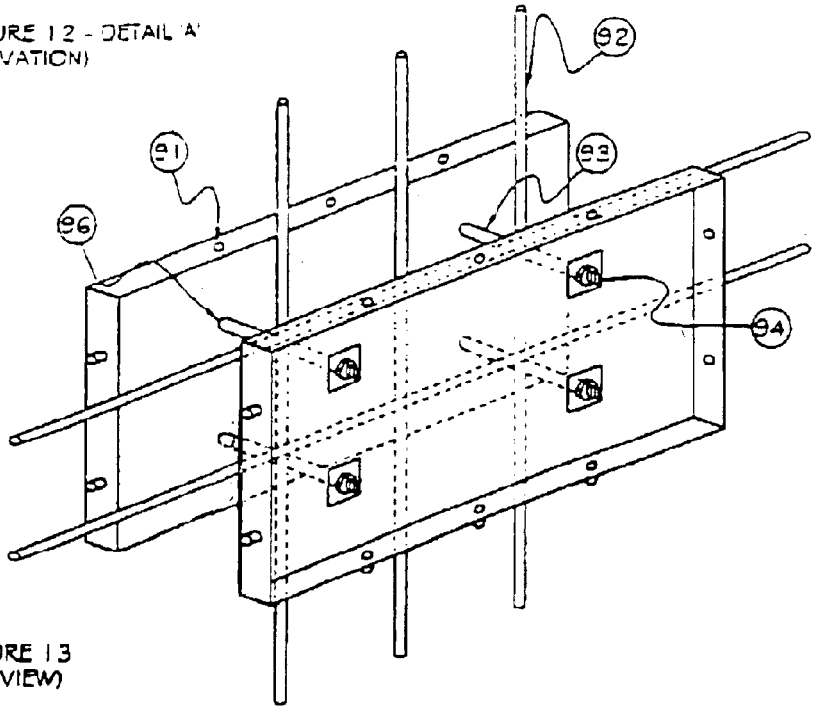
FIGURE 13
(3D VIEW)

(PLAN)

(3D VIEW)

(PLAN)

(PLAN)

(ELEVATION)

(PLAN)

(PLAN)

(3D VIEW)

(PLAN)

(ELEVATION)

(PLAN)

(ELEVATION)

(ELEVATION)

(ELEVATION)

(ELEVATION)

(ELEVATION)

(SECTION)

(SECTION)

(PLAN)

(ELEVATION)

(ELEVATION)

(SECTION)

(ELEVATION)

(SECTION)

(ELEVATION)

(ELEVATION)

(SECTION)

(SECTION)

(ELEVATION)

(ELEVATION)

(ELEVATION)

(ELEVATION)

(ELEVATION)

(ELEVATION)

FRAME UNIT FOR USE IN CONSTRUCTION FORMWORK

FIELD OF THE INVENTION

The present invention relates to the building industry.

Primarily the invention relates to building structures which are formed using concrete.

BACKGROUND OF THE INVENTION

A typical method for constructing a building requires formwork to be provided in the shape of a wall and so as to allow concrete to be poured between the panels of the formwork and allow the concrete to set and thus form a wall.

As an example, formwork to construct a wall involves providing a number of rows of upright steel reinforcing rods which extend from a base support structure, connecting horizontal steel rods to the upright rods to form a channel between adjacent upright rods of each row and then connecting forming panel work such as plywood to the reinforcing rods so that side walls to the channel are provided and to enable concrete to be poured into the channel. When the concrete has set the formwork is removed thus providing a concrete wall.

Although the method described above for constructing a wall would appear to be relatively straight forward, complications arise in providing accurately dimensioned structures. Thus the width of a wall constructed using the above method can vary depending upon the accuracy of the location of reinforcing rods and panel formwork. In general all components required during construction of formwork must be accurately measured in order to achieve the desired dimensions of the finished structure.

In addition to the above whenever structures which include irregularities are required much care and attention must be taken in constructing the formwork for this applications. Thus a wall which requires a bevelled end face or curves or lintels generally increases the labour required in constructing the desired formwork.

The present invention provides an alternative to the conventional methods for constructing structures as described above.

SUMMARY OF THE INVENTION

According to one aspect of the present invention there is provided a frame unit for use in construction formwork comprising a plurality of frame components including first and second frame components and connection means for connecting frame components together to form an assembled frame; wherein a plurality of frame units are arranged to be assembled to form formwork for a wall.

Preferably the frame unit includes reinforcing means for strengthening a wall foraged using the frame unit.

The first frame component may comprise a first wall section.

Preferably the second frame component comprises a second wall section.

Each frame component may comprise an elongate member.

Preferably each elongate member is configured to form a continuous loop of a predetermined shape.

The predetermined shape may be rectangular, square, triangular or any other shape required to form a structure.

Each elongate member may be configured to form a wall frame.

Each frame component may be assembled to form a unit having side and end walls.

Preferably the first frame component forms a side wall of the assembled frame.

The second frame component may form an end wall of the assembled frame.

Preferably the assembled unit comprises two first frame components and two second frame components.

Preferably the frame unit is in the form of a skeletal frame of a building block.

It is preferred that the reinforcing means includes a plurality of elongate elements.

The reinforcing means may include a plurality of elongate elements connected to form a grid pattern.

The frame components may be assembled with at least part or the reinforcing means extending therethrough.

It is preferred that the reinforcing means is a planar mesh formed from crossing elongate elements.

The frame components may be assembled with the reinforcing means located between side wall frame components and extending upwardly and downwardly therebetween.

The reinforcing means may comprise vertical and horizontal rods welded to form a mesh.

Preferably the reinforcing means comprises a plurality of metal grids.

The metal grids are preferably arranged in parallel with predetermined spacing therebetween.

It is preferred that the end wall frame components are arranged to abut with respective upright elongate elements of the reinforcing means.

The end wall frame components may be arranged to abut with respective horizontal elongate elements of the reinforcing means.

According to one embodiment frame components of the frame unit are angled with respect to a vertical plane.

It is preferred that the connection means comprises an elongate connection member and at least one fastening means for connecting frame components thereto.

It is preferred that the connection means interconnects two frame components.

The connection means may comprise a plurality of elongate connection members each adapted to be connected to a plurality of frame components with the fastening means.

It is preferred that each elongate connection member extends between adjacent corners of frame components.

The mesh may be connected to frame components.

It is preferred that the elongate connection members comprise horizontal rods which are arranged to run in parallel with the top and bottom horizontal parts of the end frame components.

Preferably the elongate connection members are connected by clips to the corners of the frame unit.

The clips may be spring clips.

It is preferred that the ends of the elongate connection members extend beyond the corners of the frame unit.

The fastening means may include wire which is used to connect the elongate connection members to the frame unit. Alternatively the fastening means may be an adhesive or fibreglass or any other suitable means for fastening the elongate connection members to the frame unit.

According to one embodiment the frame unit is assembled to form a cage.

According to another embodiment the elongate connection members have threaded ends which are arranged to receive threaded nuts.

The elongate connection members may include removable retainers located at each end.

The elongate connection members may include spacers which are receivable thereon.

The elongate connection members may be arranged to be connected to the mesh of the reinforcing means.

According to another embodiment the elongate connection members comprise round hollow plastic tubes through which a metal bolt can be placed.

According to another embodiment the frame unit includes a plurality of panels adapted to be connected to the assembled frame.

Each panel may have a predetermined shape.

Each panel may comprise openings for receipt of ends of the elongate connection members.

Preferably each panel comprises coupling means for coupling adjacent panels together.

The panels preferably comprise openings through major faces thereof.

The coupling means may be male of female portions which are adapted to couple with matching male or female portions of another frame unit.

It is preferred that the male or female portions consist of holes and spigots, or alternatively channels and spigots.

The panels may form side walls of the frame unit.

Ends of the elongate connection members may be secured by attachment means such as nuts and clips to the panels.

At least one hole is provided through each panel and an attachment means is arranged to be located at the end of the elongate connection members to secure each panel to the frame unit.

Each coupling portion is preferably located on an edge face of the panel.

The panels may be plastic, plywood, steel or cardboard.

According to one embodiment the panels are made of cardboard and have flaps which are arranged to be connected to flaps of other panels in lieu of a coupling means.

It is preferred that the panels are removable and/or reusable.

The coupling means preferably provides rigidity to a plurality of assembled frame units.

It is preferred that spacers for the elongate connection members are used to separate the panels from adjacent frame components.

It is preferred that end portions of the reinforcing means extend into adjacent frame units so as to overlap end portions of reinforcing means of other frame units.

It is preferred that a plurality of reinforcing means are provided for each frame unit.

Where there is a plurality of reinforcing means it is preferred that these are arranged in a parallel layered arrangement.

According to another embodiment of the present invention there is provided a method of constructing formwork for a building structure comprising the steps of forming a frame unit by connecting a plurality of frame components together using a connection means to form an assembled frame with openings to allow for entry of a settable substance, providing a reinforcing means and connecting the reinforcing means to the frame unit and connecting panels to the frame unit to form a module which is movable to be connected to another module.

Preferably each module comprises coupling means for enabling modules to be coupled together.

It is preferred that the step of connecting the plurality of frame components together includes connecting elongate members across adjacent frame components.

The step of connecting the plurality of frame components together preferably includes providing a plurality of frame components of a predetermined shape and arranging the frame components to form a frame of a predetermined shaped.

It is preferred that the frame unit has a three dimensional shape.

Preferably each frame component comprises a loop of steel.

The frame component may be a hoop component.

The frame component may be annular.

It is preferred that the frame component comprises an elongate element configured to a predetermined shape.

According to another aspect of the present invention there is provided a panel having major faces and edge faces with openings through the major faces adapted to receive ends of elongate members and coupling means for coupling panels together.

It is preferred that the coupling means are located on the edge faces.

According to another aspect of the present invention there is provided a system for constructing a building structure including a plurality of modules each including a frame component.

BRIEF DESCRIPTION OF THE DRAWINGS

A preferred embodiment of the present invention will now be described by way of example only with reference to the accompanying drawings in which:

FIG. 1 shows a reinforced steel formwork frame according to a first embodiment of the present invention;

FIG. 2 shows a reinforced steel formwork frame according to a second embodiment of the present invention;

FIG. 3 shows the formwork frame of FIG. 1 with panel support ties according to a first embodiment;

FIG. 11 shows a schematic diagram of similar panels connected together;

FIG. 12 shows male and female couplings for connecting panels together;

FIG. 13 shows a finished module according to a first embodiment of the present invention;

FIG. 35 shows a side view of another type of tie according to the present invention;

DESCRIPTION OF THE PREFERRED EMBODIMENTS

Figure 4A:
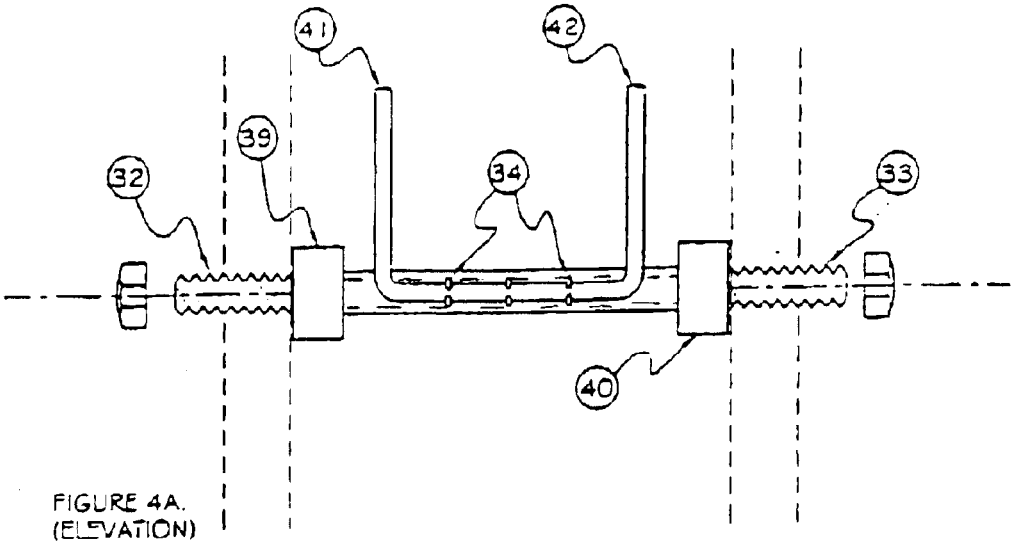
FIG. 4A shows a front view of a panel support tie shown in FIG. 3.

According to a preferred embodiment of the present invention formwork for building structures is simplified by making modules which can be connected together. A single module is made from a number of unique components.

As shown in FIG. 1 a formwork frame 11 is constructed from a number of base elements which in this embodiment consist of two rectangular side wall frame elements 12, 13 and two rectangular end wall frame elements 14, 15. Each frame element is formed from a steel rod which is bent into a rectangular shape and welded at its end to form a continuous loop. A frame element could be formed by connecting together a number of straight steel rods to form a continuous loop. A steel reinforcement mesh 16 is provided and in this embodiment in a vertical orientation between the side wall frame elements 12 and 13 with three upright rods 17, 18, 19. The frame elements 12, 13, 14 and 15 are assembled to form a box like frame structure with the reinforcing mesh 16 located with upright rods 17 and 19 in abutment with the end walls 14 and 15 and located approximately mid way between side framework elements 12, 13.

In the second embodiment of the invention shown in FIG. 2 two reinforcement meshes 20, 21 are provided side by side and parallel to each other so that there is a small space between them. According to other embodiments of the invention additional reinforcement meshes may be provided and also reinforcements of a different configuration.

With the frame elements 12, 13, 14, 15 assembled as in FIG. 1 they must be connected together to form a single box like frame 30. As shown in FIG. 3 these components may be connected together using wire. The ends of the support ties 31 are provided with a threaded section 32, 33.

Clips 34 are provided to connect the support ties to the adjacent horizontal walls 35, 36, 37, 38 of the end frame elements 14, 15.

The clips 34 may be any suitably designed clip which is able to connect two rod-like components together.

The support ties 31 also include spacer elements 39, 40 which enable a separation to be achieved between side frame elements 12, 13 and end wall elements 14, 15.

FIG. 4A also shows how vertical sections 41, 42 of the side frame elements 12, 13 can be connected to the clips 34. The clips 34 may include two socket elements having resilient finger elements which are able to grip the vertical sections 41, 42 and the horizontal sections 35, 36, 37, 38.

Figure 4B:
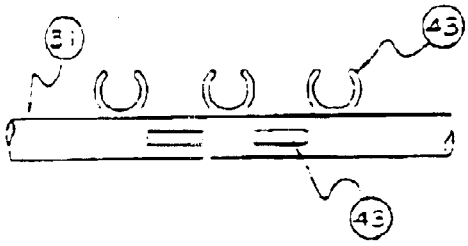
FIG. 4B shows a tie with integrally formed clips.
Figure 4D:
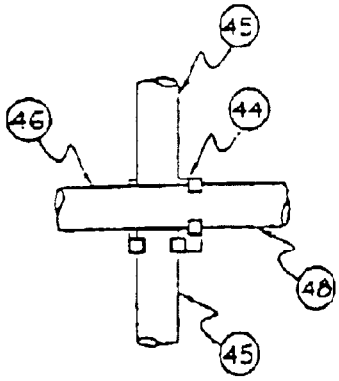
FIG. 4D shows intersecting reinforcing bars held by clips.

If it is desired to use continuous steel inside the modules the panel support ties 31 may be provided with peripheral clips 43 formed thereon as shown in FIG. 4B. The clips 43 are C-shaped and are adapted to clip onto continuous steel reinforcing and can also be used for steel mesh.

The clips 43 are arranges in a line along the length of the rod elements 31 and are arranged to be mutually perpendicular so that they can clip onto steel rods in mutually perpendicular planes.

It is also possible to have different sized clips at different locations along the length of the rods 31 so as to cover applications of steel of different thicknesses and located in non-uniform positions.

In the embodiment shown in FIG. 4B the clips 43 can carry horizontal steel in combination with vertical steel.

Figure 4C:
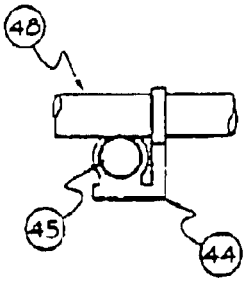
FIG. 4C shows a different type of clip and its implementation for connecting steel rods together.

According to another embodiment shown in FIG. 4C, a double sided clip 44 may be provided to join horizontal steel 45 to vertical steel 46 in between the ties.

Figure 5:
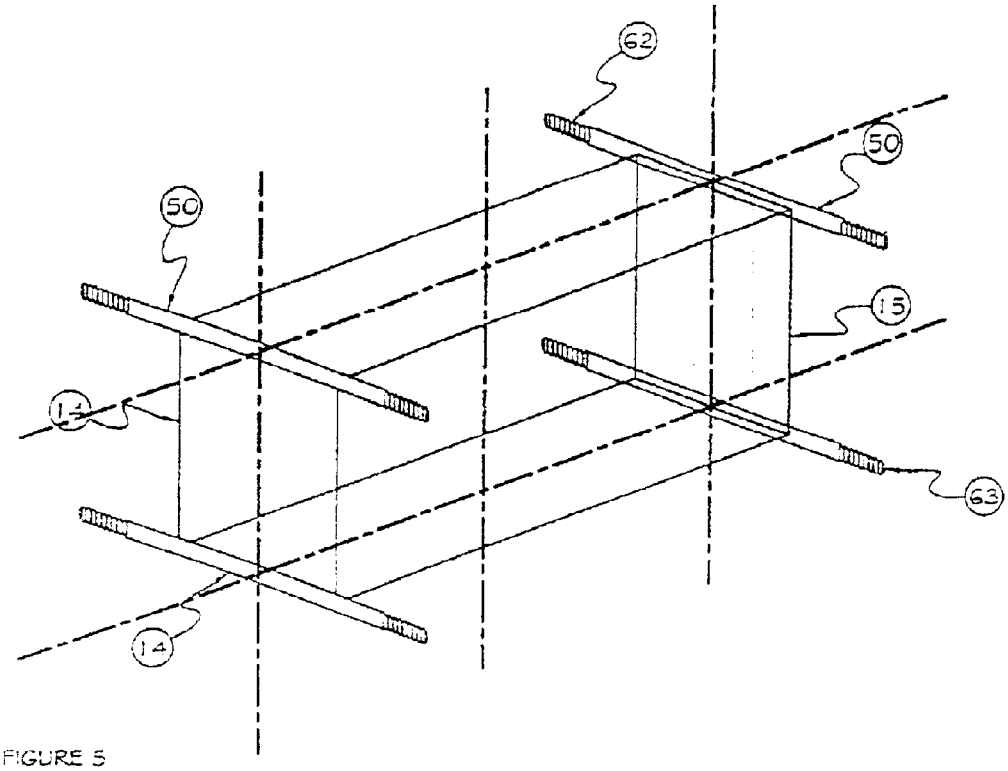
FIG. 5 shows a perspective view of a formwork frame with panel ties according to a second embodiment of the present invention.
Figure 6:
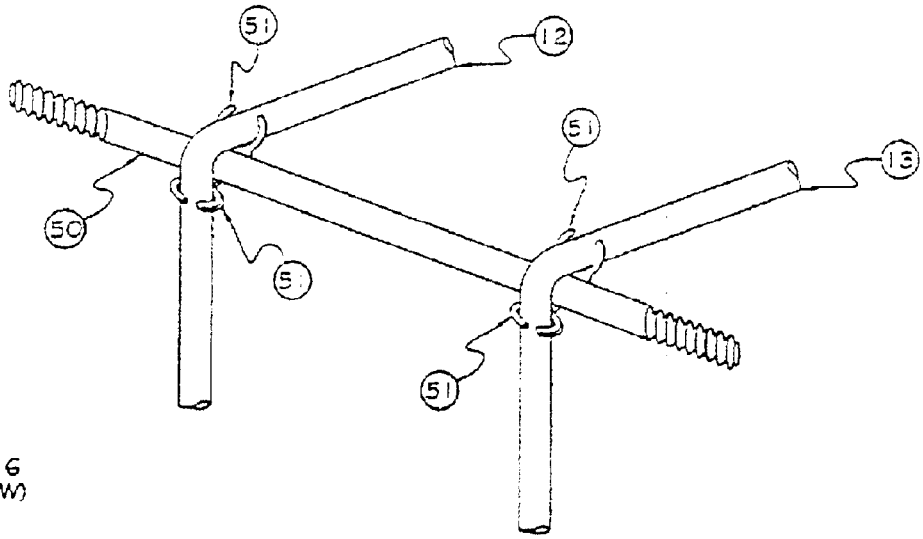
FIG. 6 shows one support tie according to the second embodiment connected to two frame elements.

According to an alternative embodiment shown in FIG. 5 and FIG. 6 panel support ties 50 consist of round hollow plastic tubes which are also aligned horizontally co-terminus with the vertical sections of the end frame elements 14, 15. Each support tie 50 is connected to the corners of each side frame element 12, 13 by using either clips 51 or by tying the tubes 50 using wire. Alternatively adhesive tapes may be used or even fibreglass may be used to bind the tubes to the side frame elements 12, 13.

A steel bolt can be inserted through the tubes 50 to provide strength to the plastic tubes so as to hold panels together and also hold the frame elements together thus acting as spacers.

Figure 7:
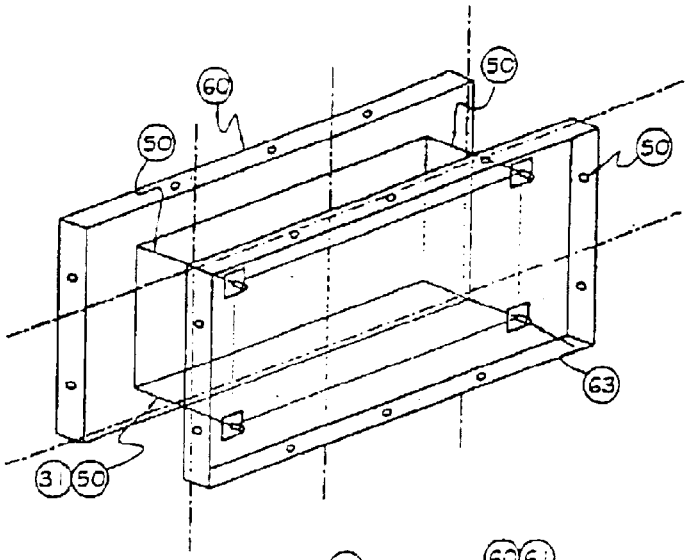
FIG. 7 shows two panels according to a first embodiment.

FIG. 7 shows two panels 60, 61 which are fed onto the respective ends 62, 63 of support ties 31, 50. In FIG. 7 only the end 63 of the support ties 31, 50 are shown.

Figure 8:
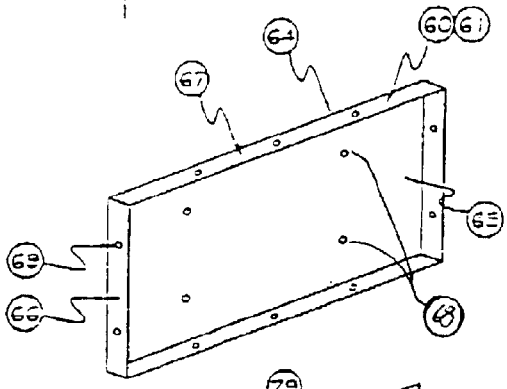
FIG. 8 shows one of the panels shown in FIG. 7.

An individual panel 60, 61 is shown in FIG. 8 more clearly and consists of a planar element having an inside major face 64 and an outside major face 65. The panel also has vertical edge faces 66 and horizontal edge faces 67 to form a substantially rectangular slab.

Each major face 64, 68 has four openings 68 provided in a symmetrical pattern close to respective corners of the panel 60, 61.

Figure 9:
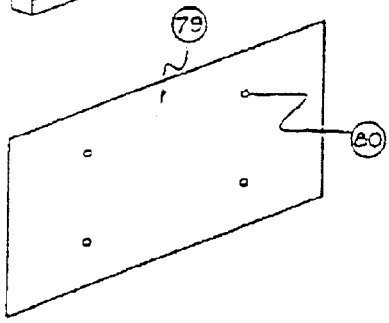
FIG. 9 shows a panel according to a second embodiment of the present invention.
Figure 10:
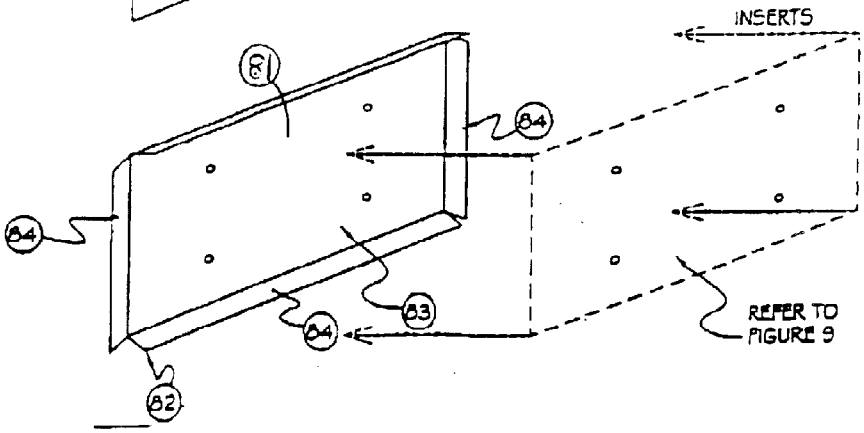
FIG. 10 shows a liner for the panel shown in FIG. 9.

Each panel could be made from steel for reusable purposes, from plastic, plasterboard or even a cardboard version is possible as shown in FIGS. 9 and 10. The panel can also be formed with one of the major faces being recessed with respect to the edge faces so as to be able to receive a liner which can have a specifically configured major face so as to leave a textured effect or pattern on concrete with which it contacts.

Each of the edge faces 66, 67 is provided with coupling portions 69 which in FIG. 8 are shown as holes. As shown in FIG. 11 however the edge faces are preferably provided with dowels in one edge face and correspondingly shaped holes in the opposing edge face. This enables adjacent panels to be connected together with the dowels of one panel connecting with the holes of an adjacent panel 73.

On the horizontal edge faces 67 especially shaped dowel 74 may be provided as shown in FIG. 12 which has a small vertical portion and its major portion running horizontally. The opposite edge face of the panel 72 is provided with a protruding cylindrical socket 75 which is adapted to receive the horizontal portion of the dowel 74.

In an alternative embodiment shown in FIGS. 9 and 10 the panels may be made of a sheet of cardboard 79 with holes 80 provided in a similar configuration to the previous embodiment. A cardboard liner 81 is provided having a matching major face 83, but with peripheral rectangular flaps 84.

The panel 79 is stapled to the major face 83 of the liner 81 and the flaps 84 can be connected to flaps of adjacent panels so that panels can be connected together.

It is preferred that the panel 79 is stapled to the liner 81 and that flaps of adjacent panels are also stapled together.

FIG. 13 also shows a finished module which has rectangular panels 91 connected to the ends of support ties 93 with nuts 94 screwed onto the ends of the ties 93 to fix the panels in position in a vertical orientation on either side of the inside frame. As shown the spacers 96 separate the panels 91 from reinforcement 92.

FIG. 13 shows how the ends of the reinforcement mesh 92 extend above, below and beyond the side walls of both the panels 91.

Figure 14:
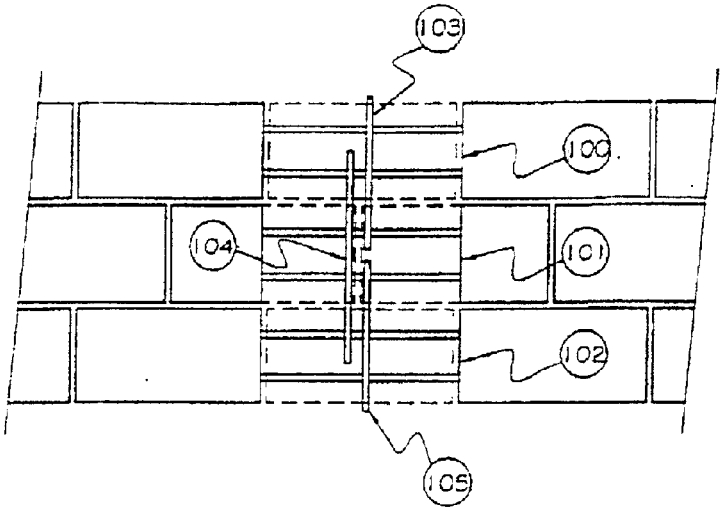
FIG. 14 shows an end elevation of a number of vertically stacked modules.

In FIG. 14 three finished modules 100, 101, 102 are stacked vertically and the reinforcement mesh of each module is shown as 103, 104 and 105. The Lowermost limit of the reinforcement mesh 103 of module 100 extends almost as far as the top reinforcement mesh 105 of the bottom most unit 102, while the middle unit 101 has its reinforcement mesh 104 spaced from the other two reinforcement meshes 103, 105, but in parallel to both of these meshes, thus providing a continuous vertical reinforcement from one module to the next.

According to another variation the middle units 101 can be offset inwardly with respect to the upper and lower units 100, 102.

Figure 15:
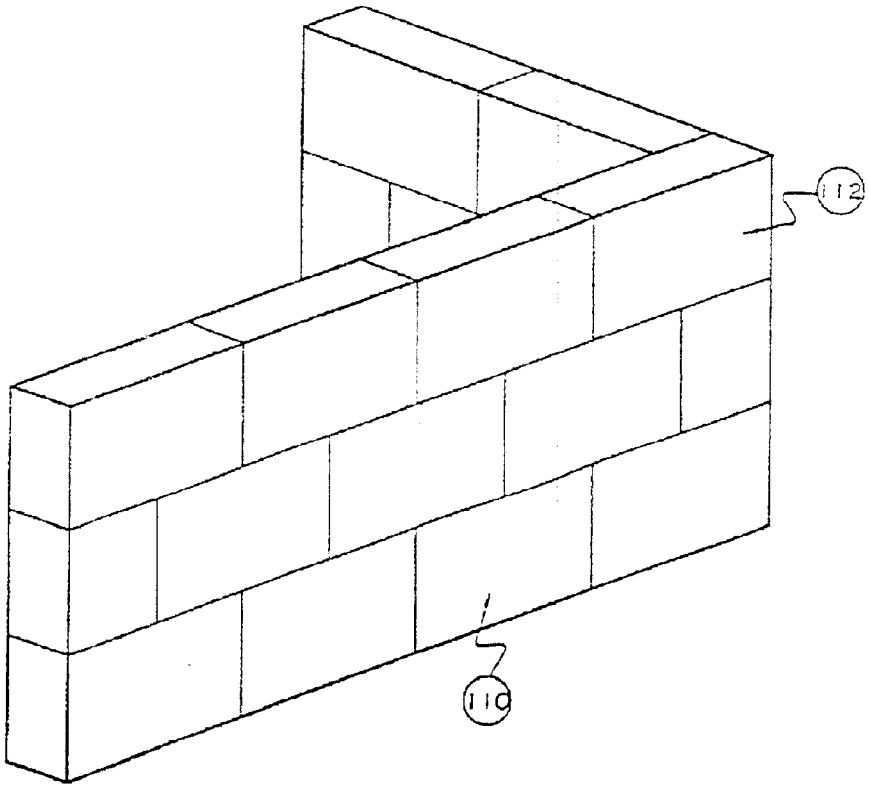
FIG. 15 shows a section of wall according to a first embodiment.
Figure 16:
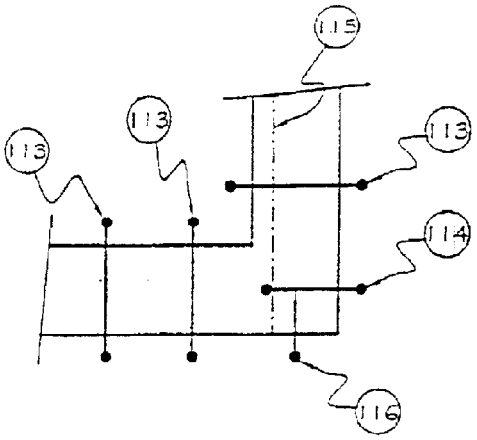
FIG. 16 shows a formwork frame for corner forms according to a first embodiment of the invention.

As shown in FIG. 15 a wall may be assembled by having a series of modules connected together in a similar fashion to how bricks would positioned in a wall. It should be noted however that where it is necessary to construct a corner or an end to the wall, modules of different shapes are required, thus a half module 111 is required in the lowermost section of the wall at one end thereof and a corner module 112 is required at the opposite end of the wall in the second layer. Thus as shown in FIG. 16 a corner module is made from frame elements which are connected together to form a right angled block frame with panel support ties 113 being connected across opposing side frame elements and in addition one support tie 114 being connected to the reinforcing mesh 115 which is opposite the side frame element near the outermost corner. Another support tie 16 connects to the support tie 115 from the other side of the corner.

Figure 22:
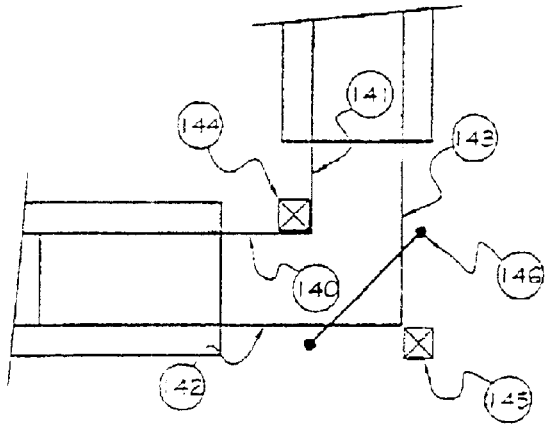
FIG. 22 shows a top view of an alternative method for connecting corner modules together.

According to a different embodiment of the present invention a corner tie is so designed as to hold the corners together securely as shown in FIG. 22. Thus panels 140 and 141 are connected at right angles to form an inner corner, and panels 142, 143 are connected at right angles to form an outer corner.

Batons 144, 145 are located inside the inner corner panels 140, 141 and outside the outer panels 142, 143. Each bacon 144, 145 runs down the outer and inner corners secured by screws for additional strength. The inner panels 140, 141 may vary depending on the width of the wall.

The corner tie 146 connects outer panels 142, 143 and extends diagonally across the outside corner.

With such an arrangement walls can be formed at any particular angle with respect to each other with the batons providing reinforcement without the need for a cable tie to connect to inside reinforcing mesh.

Figure 17:
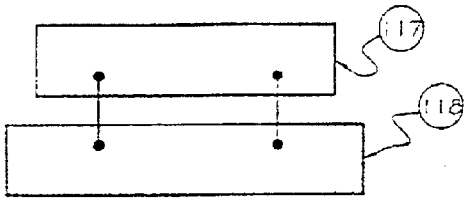
FIG. 17 shows a formwork frame according to a third embodiment.

As shown in FIG. 17 a curved wall may be formed by having one of the side frame elements 117 shorter than the other 118. Thus when adjacent modules tare connected together one module will need to be angled with respect to the next so that the ends of each module abut.

Figure 18:
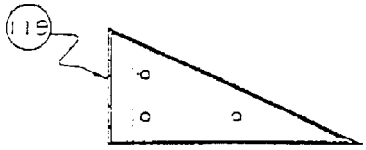
FIG. 18 shows a formwork frame according to a fifth embodiment.

A further embodiment of the invention shown in FIG. 18 includes panels 119 having a triangular configuration.

Other embodiments of the present invention are also covered by the invention and include panels which have one, two or three holes and which thus may be one quarter, one half or three quarters of a standard module which is shown in FIG. 13.

According to another embodiment of the present invention a module may be formed having a round shape so that the frame elements may be formed from a series of rings which are connected together using the aforementioned techniques. In such a case a curved panel would be required.

If it is desired to form a cavity an object of any suitable material is placed in between the panels of the module, steel ties of a suitable material are preferably provided in the object that forms the cavity. This therefore enables two concrete walls to be tied together that are formed from pouring inside the module.

Figure 19:
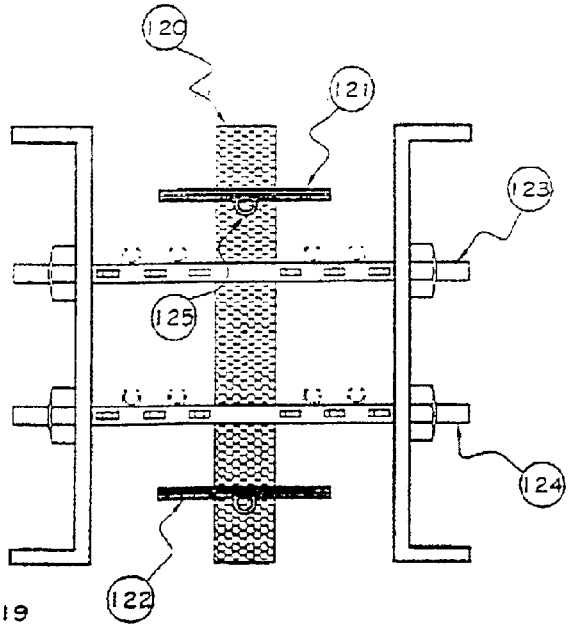
FIG. 19 shows two panels connected together according to a second embodiment of the invention.

FIG. 19 shows an object 120 which may be polystyrene for example with steel ties 121, 122 extending transversely therethrough at upper and lower locations. Upper and lower panel support ties 123, 124 are shown having integrally formed clips as shown in FIG. 4B.

Figure 20:
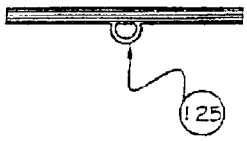
FIG. 20 shows a support tie according to a third embodiment of the present invention.

The steel ties 121, 122 are preferably provided with lugs or clips 125 shown more clearly in FIG. 20.

Figure 21:
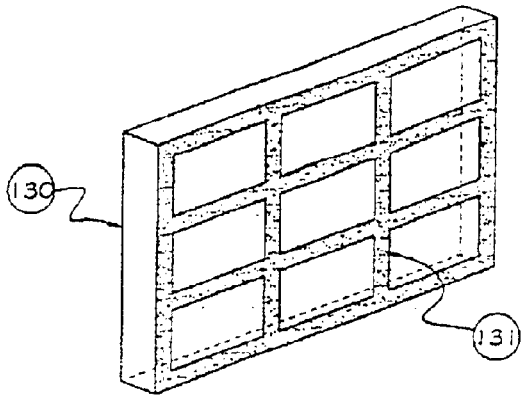
FIG. 21 shows a subframe assembly for a module according to a further embodiment of the present invention.

According to another embodiment of the invention a module may be formed using subframe assemblies as shown in FIG. 21. Such a subframe assembly 130 which consists of a rectangular outer frame may be made of any suitable rigid material and can carry a lighter material such as cardboard or thin plastic. The frame 130 comprises a lattice 131 of metal rods, plastic rods or any other type of inner support for the frame 130. Furthermore, the lattice can be replaced by diagonally run supports or equivalent supporting structures.

FIGS. 4A, 4B and 4C showed different types of panel support ties used in forming individual modules. Set forth below are alternative types of support ties which may also be used.

Figure 23:
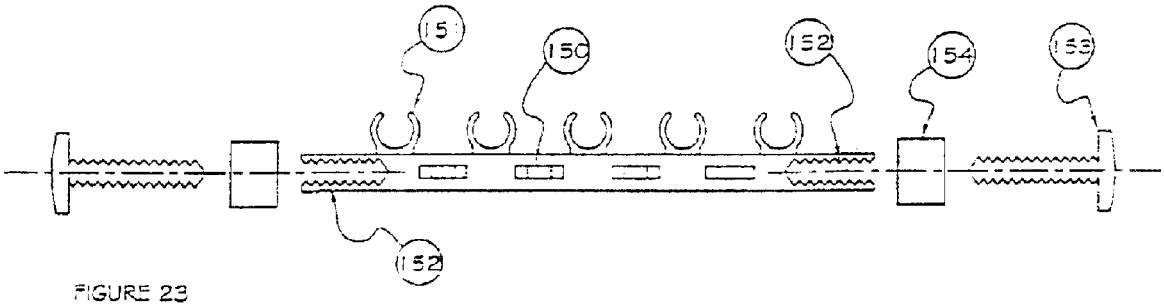
FIG. 23 shows a screw in type support tie.

In FIG. 23 a screw-in type support tie is shown consisting of an inner rod 150 having peripheral reinforcing rod clips 151 aligned in rows with each row being displaced by 90° with respect to an adjacent row.

The outer ends of the rod 150 are provided with threaded internal bores 152 which are adapted to receive end screws 153 with an optional ferrule 154. The ferrules can vary in size and are detachable so that they can be removed after concrete has been poured and set. Optionally the ferrule 154 could also be built into the panel or formwork.

According to another embodiment of the present invention the ferrule 154 is enlarged so as to fit into a recess in a panel whereby the end screws 153 fit through a hole in the recess in the panel so as to connect with the tie after insertion through the ferrule. This allows for perfect alignment of the cable tie with respect to a panel.

The above described embodiment also allows for webbing to be introduced for added support. Thus a girder may be connected to the enlarged ferrule below the rod 150 to strengthen the tie and this girder say be connected at various points along the length of the girder to the rod.

According to another variation of the above embodiment the ferrule could be a split ferrule split vertically so as to allow a specially shaped end piece to fit into the recess of a panel. This end piece has a protrusion with a vertically placed hole therethrough to allow for a pin to be inserted to locate it in position within the panel recess.

Figure 24:
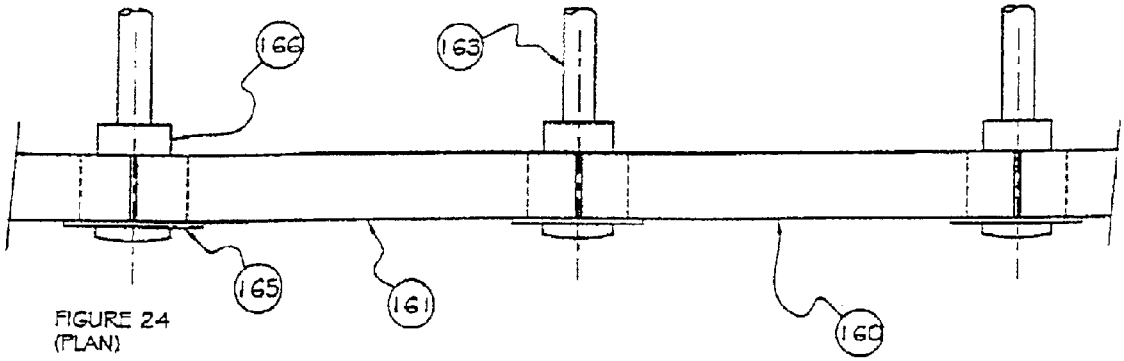
FIG. 24 shows a corner tie according to a further embodiment of the present invention in top view.
Figure 25:
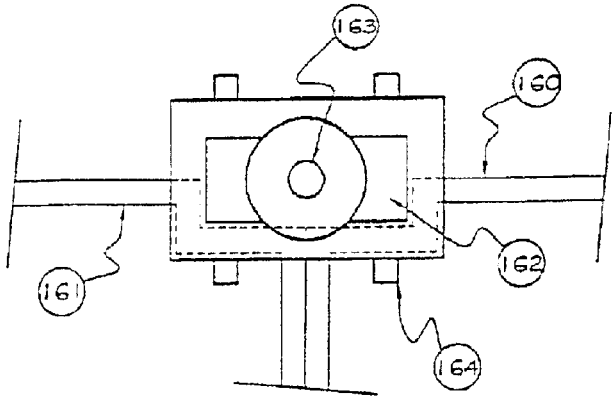
FIG. 25 shows a front view of a further embodiment of a corner tie according to the present invention.

A corner tie may be provided as shown in FIGS. 24 and 25.

For adjacent modules 160, 161, the adjacent corners of the modules 160, 161 are provided with stepped recesses which form a combined recess in which the support tie 163 is supported.

At its outer end the tie 163 can contain either keys, ribs or lock teeth as shown in FIG. 2 or any combination of these. Ferrules 166 are provided on the inner side the module as shown in FIG. 24.

Figure 26A:
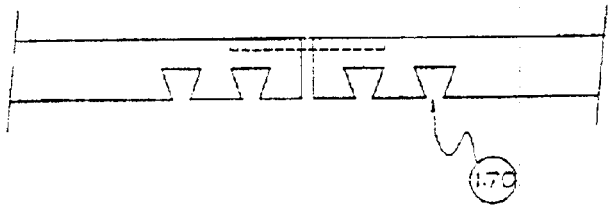
FIG. 26A shows a top view of a corner panel tie according to the present invention.

FIG. 26 shows corner panels tied together using a wedge key system in which the ends of the panels are provided with wedged shaped key ways 170 and wedges are used to connect these panels together.

Figure 26B:
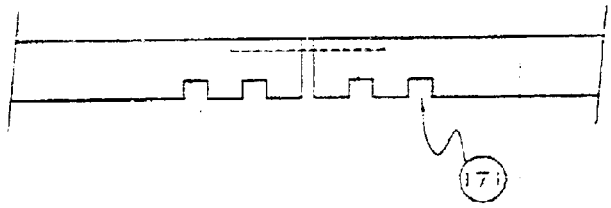
FIG. 26B shows a top view of a corner tie according to a further embodiment of the present invention.
Figure 27:
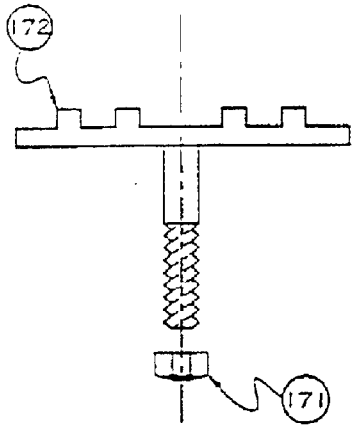
FIG. 27 show a clip used with a corner tie for FIG. 26B.

FIG. 26B shows another key way system for corner panels in which the key ways 171 are straight. In FIG. 27, a key plate 172 is shown which is adapted to fit into the straight key ways 171 in combination with a threaded bolt or clip 173 actually clicks on and is U-shaped. The clip stops the panels or forms pushing out and separating vertically during concrete pouring.

The corner tie attachment described above is able to prevent movement in six different directions.

Figure 29:
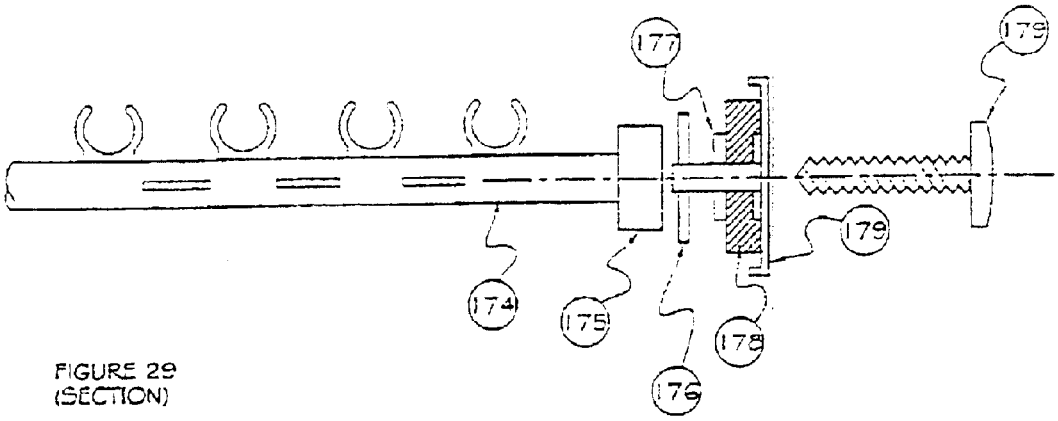
FIG. 29 shows a front sectional view of components of a support tie according to a further embodiment of the present invention.

As shown in FIG. 29 the support tie 174 has a ferrule 175, hold plate 176, tooth 177, rib 178, outer plate 179 and end screw 180.

Figure 28:
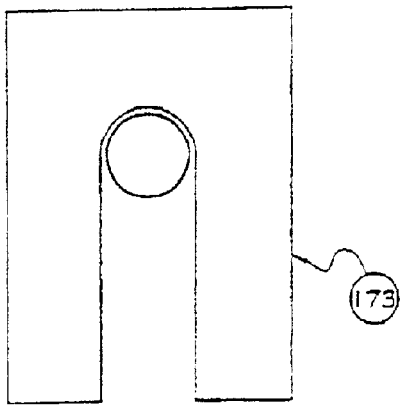
FIG. 28 shows an end view of a clip according to another embodiment of the present invention.

The outer plate can be independent of this arrangement as shown in FIGS. 27 and 28.

The above type of support tie can be used along any part or place of the outside form.

Figure 30:
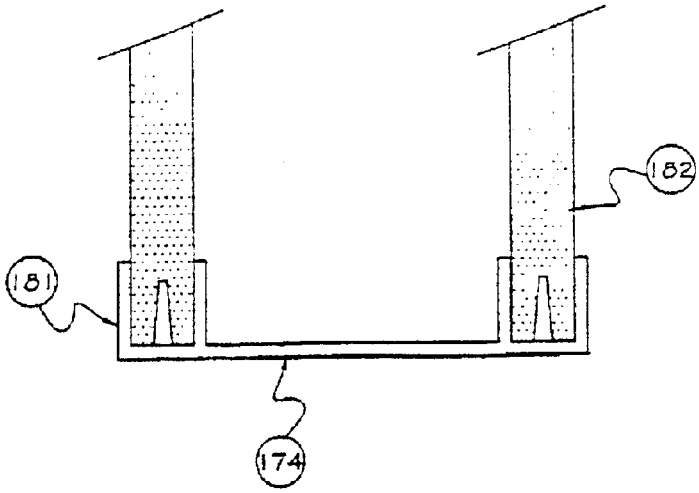
FIG. 30 shows a front view of a support tie according to another embodiment of the present invention.

A half version of these support ties can be produced for the bottom of the form when they are first arranged. In this embodiment the forms 182 rest on the support tie and the outer plates extend upwardly at each end as shown in FIG. 30.

This bottom tie can be made in a single piece or can be adapted with a smaller screw. Alternatively it may be tied higher up where the initial form had its bottom ties.

It should be noted with the corner ties that the modules may be assembled on site instead of at the factory.

According to another embodiment of the invention ties can be produced with one thick side and the other side normal with an end screw. It should be noted that the hold plate is preferably rebated into the panel form.

Figure 31A:
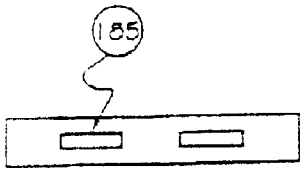
FIG. 31A shows a top view of a plate for a support tie according to one embodiment of the present invention.
Figure 31B:
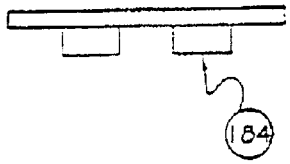
FIG. 31B shows a side view of a toothed tie for use with the plate shown in FIG. 31A.

If the support ties are moved out of the corner the rebate in the forms is filled with a tie having teeth 184 and corresponding opening 185 as shown in FIGS. 31*a* and 31*b*.

Figure 31C:
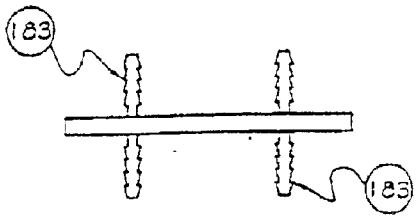
FIG. 31C shows a toothed tie according to another embodiment of the present invention.

According to an alternative embodiment the support ties are provided with serrated teeth 183 protruding radially therefrom as shown in FIG. 31C. The serrated teeth 183 provide better grip and can also be double-sided.

This tie can also be used anywhere along the inside of the form on the interior of it to hold panels together. The teeth 183, 184 can also be grooved for extra grip.

Figure 32:
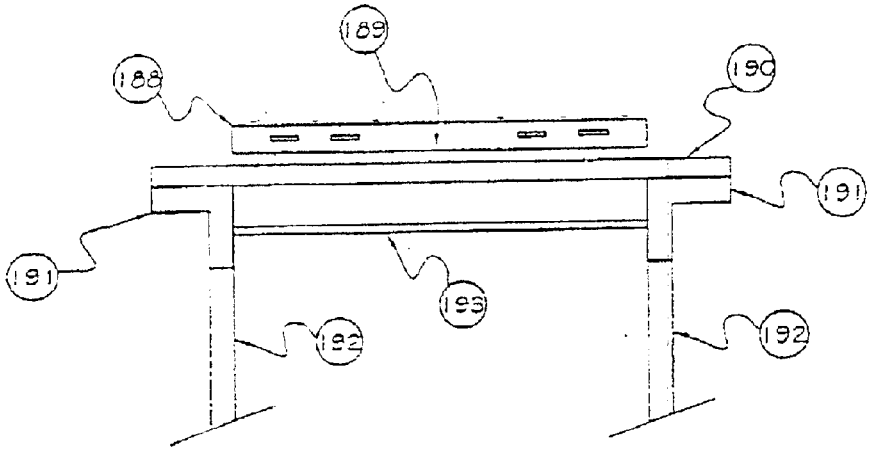
FIG. 32 shows an end view of a strap tie according to the present invention.

A further embodiment of the present invention includes strap ties. These ties as shown in FIG. 32 do not screw off, instead they have to be cut off.

A strap tie 188 is provided with peripheral clips as discussed previously and is also provided with lower teeth on its outer periphery 189. A strap 190 extends over the top of two adjacent forms and wraps around end flanges of each form 192 to hold them in place. A rib 193 separates both forms 192.

The rib 193 is clicked in position and a snap-on piece slides over the ribs snap-in teeth. The rib in addition to providing strength also acts as a spreader.

Figure 33:
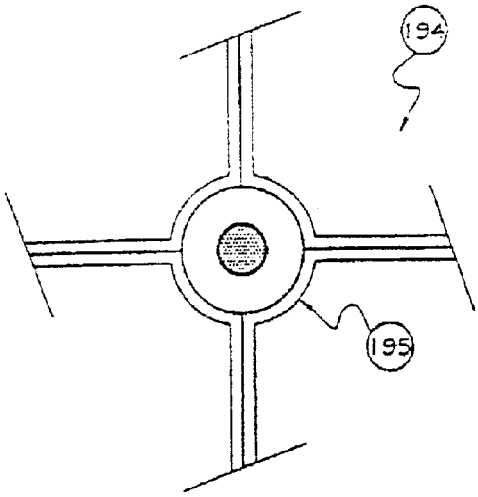
FIG. 33 shows an end view of a screw type tie according to the present invention.
Figure 34:
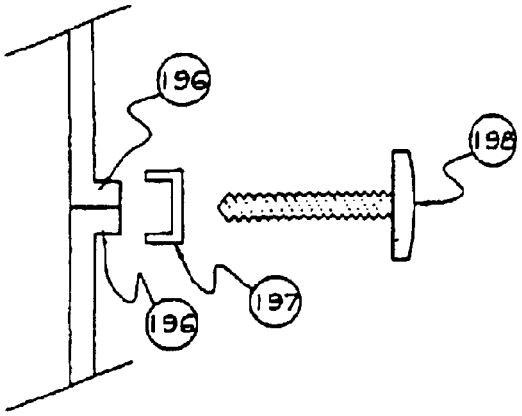
FIG. 34 shows a side view of the screw type tie shown in FIG. 33.

According to another embodiment of the present invention key locks and cam ties are used to connect formwork together. Both of these methods operate on the same principle as the screw-in end screws but instead of screwing they are fixed in place by turning the key lock so that it fits in the specially configured key way or is wedged in position due to the cam surface provided at the end of the cam lock. According to another version of the invention shown in FIG. 33 four adjacent modules are connected together using a screw type connection 195. As shown more clearly in FIG. 34 each of the forms 194 have a lug 196 located in their abutting corners. These lugs or flanges are covered by a cover element 197 which is U-shaped and a screw 198 holds the cover in place.

Figure 35:
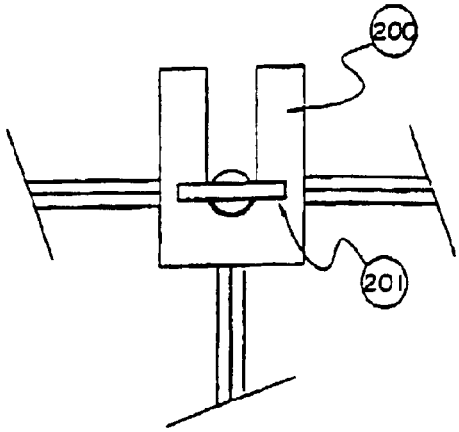
FIG. 35 shows an end view of another type of tie according to the present invention.

According to another variation of the present invention a keyed plate as shown in FIG. 28 or a plate with ribs either side of the tie can be slid dozen to engage two forms then a tie can be placed and turned to lock the forms together as shown in FIG. 35, then when the top panels are due to be located in position it is ready to receive them in the slot provided by the legs of the U-shaped plate 200. Optionally there may also be provided a small ridge 201 which acts as a retainer to stop the tie being removed. Any other suitable means for preventing removal is also encompassed by the invention such as a cylindrical member located on the end of the tie and adapted to receive a screw which acts as the retainer.

Figure 36:
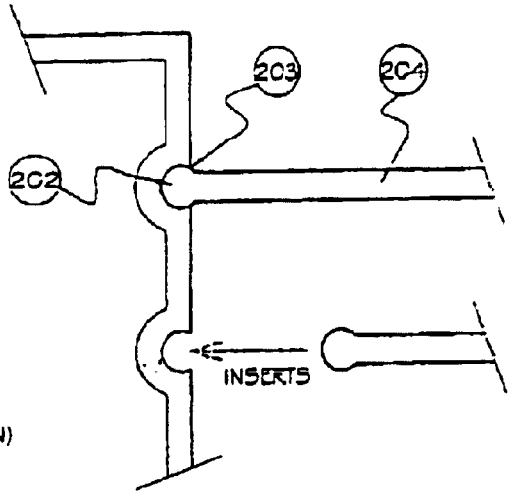

According to another embodiment of the present invention socket ties are provided in which the panels are specially provided with recessed portions 202 as shown in FIG. 36. These recessed portions 202 are adapted to receive a round knob 203 located at the end of each support tie 204. Other types of snap-in locking systems are also envisaged.

According to another variation of the present invention the ends of the support ties are insertable through holes in the modules and the ties are held in place by snap-on elements which are located on the other side of the modules.

Another type of tie envisaged by the present invention is a spool tie which has transverse portions located at each end which are adapted to fit into correspondingly shaped slots provided in the edge face of each module.

According to another variation of the invention a screw can be added through a window in the side of the module with a detachable spool being located at each end.

According to a further aspect of the present invention modules are provided with protrusions which allow a tie to be clipped thereon by a removal clip.

Figure 37A:
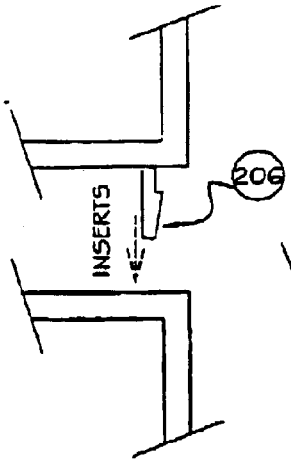
FIG. 37A shows a front view of a panel according to a further embodiment of the present invention.
Figure 37B:
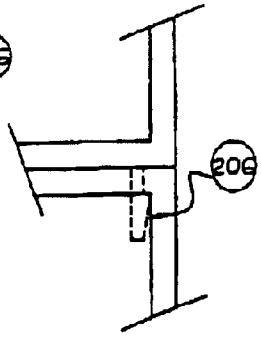
FIG. 37B shows an end view of the panel shown in FIG. 37A.

According to another variation of the present invention as shown in FIG. 37 panels 205 or forms are provided with integrally formed clips 206 which slip through an opening in a flange sects on of an adjacent form and clip into the other form, thus individual panels may be provided with interlocking components to allow them to be connected together. Alternatively they may be provided with male or female portions which are adapted to be connected together directly or through an intermediate removable member, thus modules may be provided with end flanges and slots which interlock and can be held in place by a wedge tie or dowelling strap.

Figure 38:
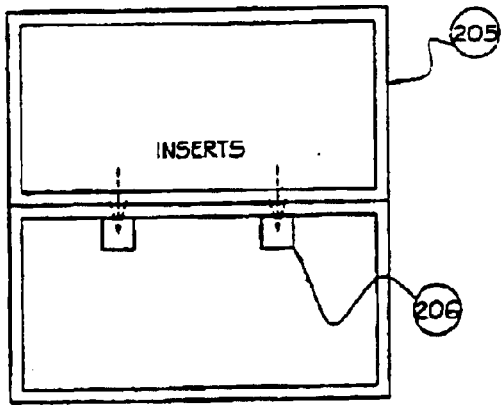
FIG. 38 is a side view of two modules in a stacked relationship.
Figure 38A:
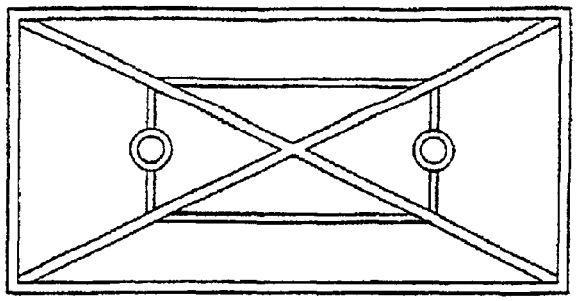
FIGS. 38A, 38B, 38C and 38D show different rib structures for panels according to the present invention.
Figure 38B:
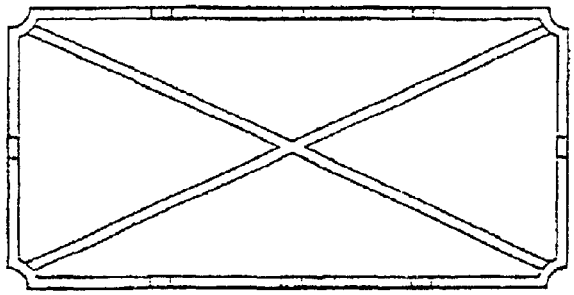
Figure 38C:
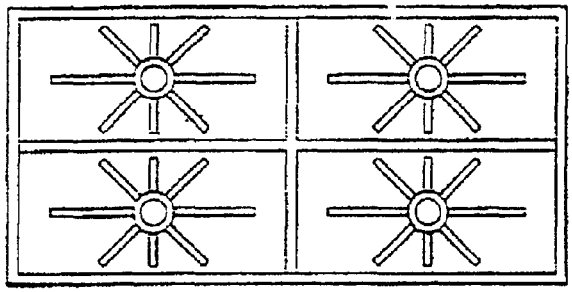
Figure 38D:
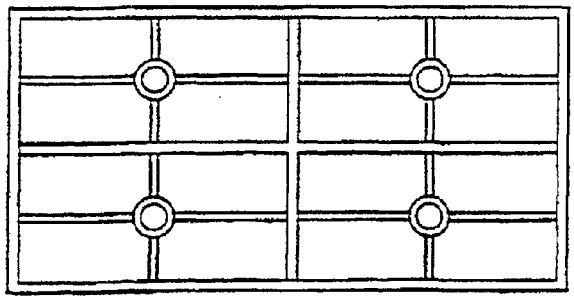

The idea of using ribs was previously discussed in relation to FIG. 29. FIGS. 38A, 38B, 38C and 38D show different configurations of ribbing which may be used to support the structure of a module. These include diagonal ribs extending between the corners of a module as shown in FIG. 38B, a combination of diagonal ribs and a rectangular rib as shown in FIG. 38A, a cross configuration of ribs as shown in FIG. 38C which also incorporates diagonal ribbing in each window formed therein and finally a series of horizontal ribs with a single vertical rib as shown in FIG. 38D.

Figure 39:
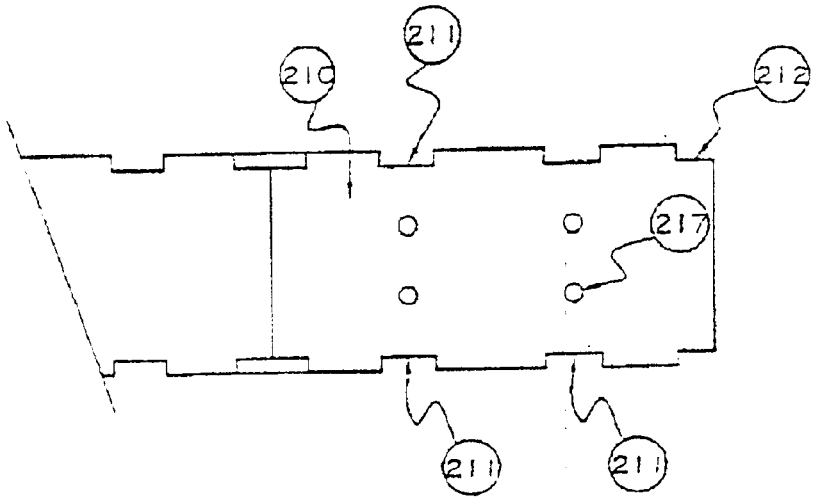
FIG. 39 shows an alternative type of panel for a module according the present invention.

According to one preferred aspect of the present invention a series of modules are able to be connected together so as to form any particular shape suitable for concrete pouring. According to an embodiment of the invention in which a universal type module is provided as shown in FIG. 39, a module 210 is provided with peripheral slots 211 in upper and lower walls thereof. The size of the module can be selected as desired depending on the particular application of use.

The corners of the module are provided with cut-away sections 212 and the recessed portions 211 are spaced preferably at regular intervals along the upper and lower wall and if the height is large enough along the side wall as well.

Through holes 213 are provided through the centre of the module 210 and as shown in FIG. 39 are arranged in pairs in axial alignment with opposing recesses 211 on the upper and lower edges of the module 210.

Using the module shown in FIG. 39 a variety of different shapes of formwork may be connected together to form individual modular building blocks forming a wall of numerous different shapes. The modules may be preformed and then taken onto site or may be formed on site as desired. It is also possible to have individual modules preconnected together either in the factory or on site.

According to another variation of the present invention panels may be provided as shown in FIG. 40. These panels have side walls provided with male portions 300 and female recesses 301. Each of the male portions 300 may be provided with a lateral hole therethrough. Adjacent panels may be connected together by interconnecting male and female portions 300, 301 and inserting a pin 302 through the coupled male and female portions.

The shape of the male and female portions may be changed and the method of interlocking the male and female portions may also be changed so as to include other locking means other than pins, for example expandable male portions may be provided to retain a male portion of another panel within a female portion located between two adjacent male portions.

What is claimed is:

1. A module for use in constructing a formwork, said module comprising:

(a) first and second wall sections, each wall section having substantially rectangular major surfaces and peripheral flanges extending from the edges of one of the major surfaces;

(b) a plurality of openings in the major surfaces of the wall sections;

(c) a plurality of rigid elongate members extending between the wall sections to secure the wall sections to each other;

(d) removable fastening means for temporarily fixing the first and second wall sections with respect to the rigid elongate members at a predetermined spacing;

(e) reinforcing rod securement means attached to the rigid elongate members allowing vertical and horizontal reinforcing members to be secured relative to the wall sections upon assembly of the modules; and (f) means for temporarily and directly securing the peripheral flanges of adjacent modules of the wall sections to form a formwork for a concrete wall which upon curing of the concrete, and upon release of the fastening means allows the wall sections to be simultaneously stripped from the concrete wall.

2. The module as claimed in claim 1, wherein the reinforcing members comprise a mesh structure.

3. The module as claimed in claim 1, wherein each wall section is rectangular.

4. The module as claimed in claim 1, wherein the wall sections have corners and each elongate member is adapted to extend between adjacent edges of wall sections to temporarily fix the first and second wall sections.

5. The module as claimed in claim 4, wherein each elongate member comprises a rod.

6. The module as claimed in claim 5, wherein the fastening means are removably attachable to the ends of the elongate members.

7. The module as claimed in claim 6, wherein each wall section is in the form of a substantially identical preformed panel.

8. The module as claimed in claim 1, wherein each wall section includes a coupling means permitting a wall section to be connected to a wall section of another module.

9. The module as claimed in claim 8, wherein the coupling means of each wall section are located on an edge.

10. The module as claimed in claim 9, wherein the coupling means comprises male and/or female portions which are adapted to couple with matching male and/or female portions of another panel.

11. The module as claimed in claim 1, wherein rigid elongated members are rods having an internally threaded bore at each end and secured to said wall sections by threaded fasteners.

12. The module as claimed in claim 1, wherein said wall sections are L-shaped.

* * * * *